US010704564B2

(12) United States Patent
Jones

(10) Patent No.: US 10,704,564 B2
(45) Date of Patent: Jul. 7, 2020

(54) PERSONAL FANNING ASSEMBLY

(71) Applicant: Jermaine Jones, Tamarac, FL (US)

(72) Inventor: Jermaine Jones, Tamarac, FL (US)

( * ) Notice: Subject to any disclaimer, the term of this patent is extended or adjusted under 35 U.S.C. 154(b) by 207 days.

(21) Appl. No.: 15/968,127

(22) Filed: May 1, 2018

(65) Prior Publication Data

US 2019/0338786 A1 Nov. 7, 2019

(51) Int. Cl.

| | |
|---|---|
| ***F04D 29/52*** | (2006.01) |
| ***F24F 7/007*** | (2006.01) |
| ***F04D 25/08*** | (2006.01) |
| ***F04D 25/06*** | (2006.01) |
| ***F04D 19/00*** | (2006.01) |

(52) U.S. Cl.

CPC ..... *F04D 29/524* (2013.01); *F04D 19/002* (2013.01); *F04D 25/0673* (2013.01); *F04D 25/084* (2013.01); *F24F 7/007* (2013.01); *F24F 2221/12* (2013.01); *F24F 2221/38* (2013.01)

(58) Field of Classification Search

CPC ..... A45C 11/00; A45C 2011/02; A45C 2011/002; F04D 19/002; F04D 25/0673; F04D 25/084; F04D 29/524; F04D 29/646; F24F 2221/12; F24F 2221/38; F24F 7/007; H04M 1/0202; H04M 1/21; H04M 1/72527; H05K 7/20145; H05K 7/20172; H05K 7/20209

USPC ..... 415/148

See application file for complete search history.

(56) References Cited

U.S. PATENT DOCUMENTS

| | | | | |
|---|---|---|---|---|
| 5,230,016 | A * | 7/1993 | Yasuda | H02J 7/0044 379/426 |
| 7,782,613 | B2 * | 8/2010 | Harris | H05K 7/20136 361/695 |
| 7,959,419 | B2 | 6/2011 | Borowski | |
| 8,085,537 | B2 | 12/2011 | Harris | |
| 8,477,490 | B2 * | 7/2013 | Rothkopf | G06F 3/016 361/679.46 |
| 9,326,556 | B2 * | 5/2016 | Leon | F24F 1/04 |
| 9,479,212 | B1 * | 10/2016 | Garcia | G06F 1/203 |
| 10,272,171 | B2 * | 4/2019 | Lin | B03C 3/155 |
| 2008/0103637 | A1 * | 5/2008 | Bliven | F16B 2/20 701/1 |
| 2010/0270188 | A1 * | 10/2010 | Dotson | A45C 11/00 206/320 |

(Continued)

FOREIGN PATENT DOCUMENTS

| | | | | |
|---|---|---|---|---|
| GB | 2380090 A | * | 3/2003 | H04M 1/56 |
| JP | 04189053 A | * | 7/1992 | |
| WO | WO2009107106 | | 9/2009 | |

*Primary Examiner* — J. Todd Newton

(57) ABSTRACT

A personal fanning assembly for cooling a user includes a shell that defines an interior space. The shell has a back that is open. A panel is coupled to the shell and defines a recess and a chamber in the interior space. The recess is configured to insert an electronic device of a user. Each of a plurality of holes that is positioned in the shell and the panel is configured to align with a respective functional element of the electronic device. A blower, which is coupled to the shell and positioned in the chamber, is configured to force air through an orifice that is positioned in a front of the shell onto the user. A plurality of slats extends between opposing edges of the orifice. The slats are positioned to shield the blower and are configured to direct the air that is forced through the orifice.

16 Claims, 5 Drawing Sheets

(56) References Cited

U.S. PATENT DOCUMENTS

| | | | | |
|---|---|---|---|---|
| 2011/0194252 | A1* | 8/2011 | Wang | A45B 27/02 361/695 |
| 2013/0344609 | A1* | 12/2013 | Mayer | G01N 33/497 436/133 |
| 2014/0233183 | A1* | 8/2014 | Horng | G06F 1/203 361/692 |
| 2015/0003008 | A1* | 1/2015 | Larsen | G06F 1/203 361/679.46 |
| 2015/0017905 | A1* | 1/2015 | Li | H05K 7/20136 454/184 |
| 2015/0355693 | A1* | 12/2015 | Chang | G06F 1/203 361/679.48 |
| 2017/0178469 | A1 | 6/2017 | Nahman | |
| 2017/0198703 | A1* | 7/2017 | Leitman | F04D 25/0673 |
| 2017/0229050 | A1 | 8/2017 | Butler | |
| 2018/0135634 | A1* | 5/2018 | Leitman | F04D 19/002 |
| 2019/0101126 | A1* | 4/2019 | Porter | F04D 25/0673 |
| 2019/0341884 | A1* | 11/2019 | Walker | H02S 40/425 |

* cited by examiner

PERSONAL FANNING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to fanning assemblies and more particularly pertains to a new fanning assembly for cooling a user.

BRIEF SUMMARY OF THE INVENTION

An embodiment of the disclosure meets the needs presented above by generally comprising a shell that defines an interior space. The shell has a back that is open. A panel is coupled to the shell and defines a recess and a chamber in the interior space. The recess is configured to insert an electronic device of a user. Each of a plurality of holes that is positioned in the shell and the panel is configured to align with a respective functional element of the electronic device. A blower, which is coupled to the shell and positioned in the chamber, is configured to force air through an orifice that is positioned in a front of the shell onto the user. A plurality of slats extends between opposing edges of the orifice. The slats are positioned to shield the blower and are configured to direct the air that is forced through the orifice.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
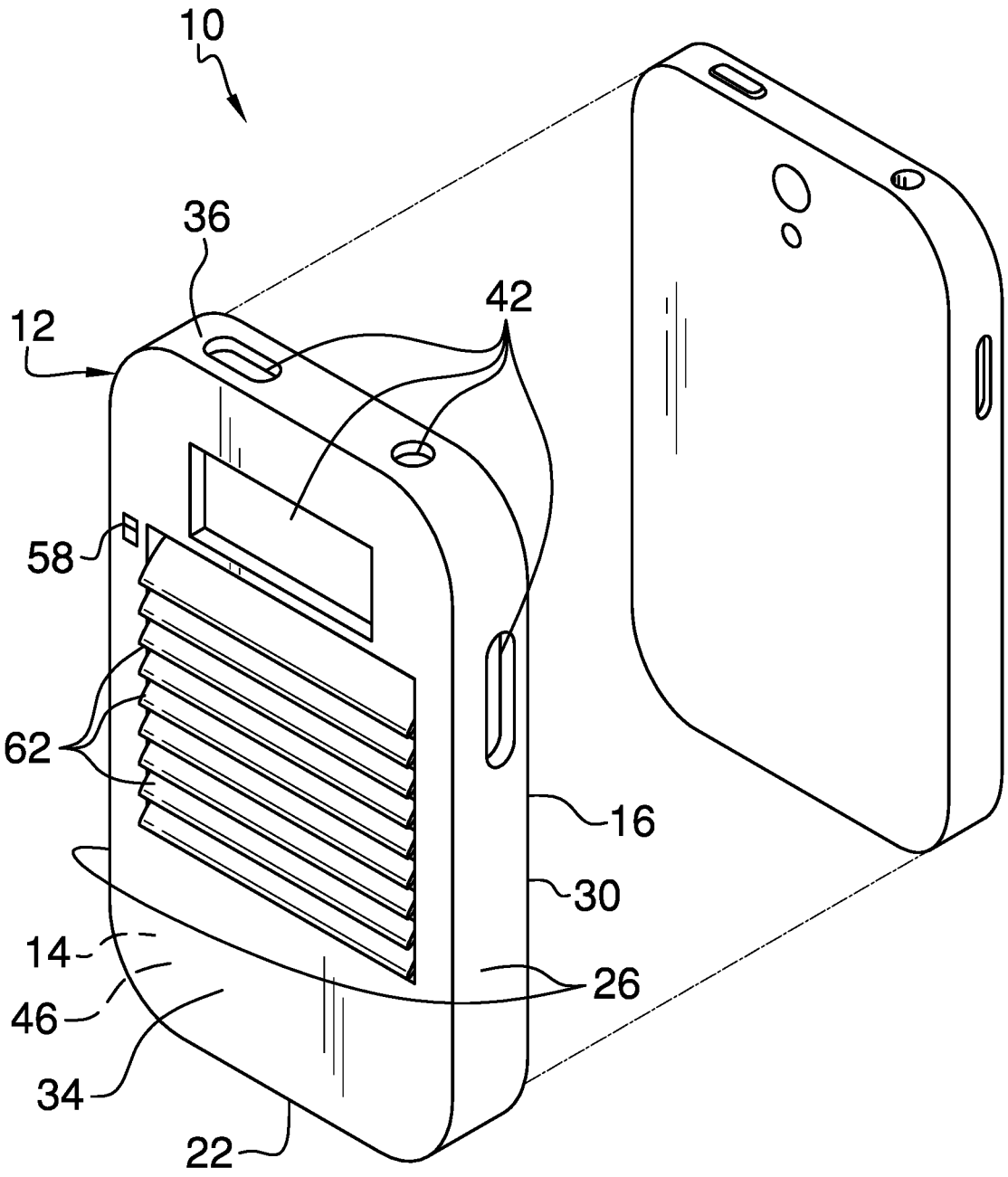
FIG. 1 is an isometric perspective view of a personal fanning assembly according to an embodiment of the disclosure.
Figure 2:
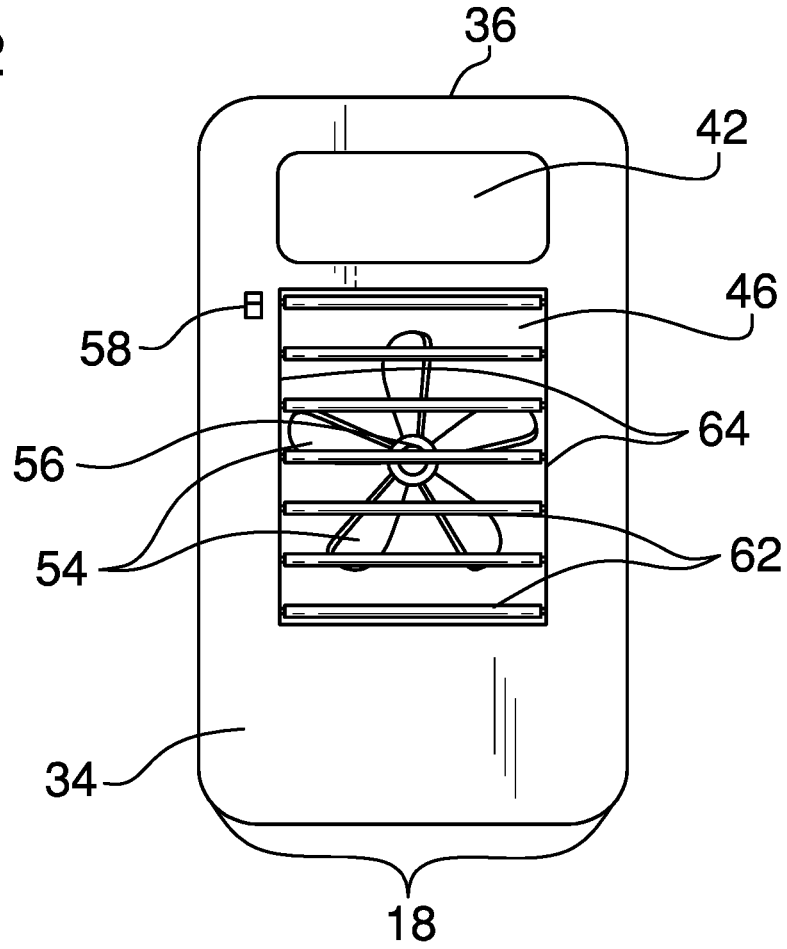
FIG. 2 is a front view of an embodiment of the disclosure.

With reference now to the drawings, and in particular to FIGS. 1 through 7 thereof, a new fanning assembly embodying the principles and concepts of an embodiment of the disclosure and generally designated by the reference numeral 10 will be described.

As best illustrated in FIGS. 1 through 7, the personal fanning assembly 10 generally comprises a shell 12 that defines an interior space 14. The shell 12 has a back 16 that is open. The shell 12 is substantially rectangularly shaped. The shell 12 has corner edges 18 that are arcuate.

Figure 7:
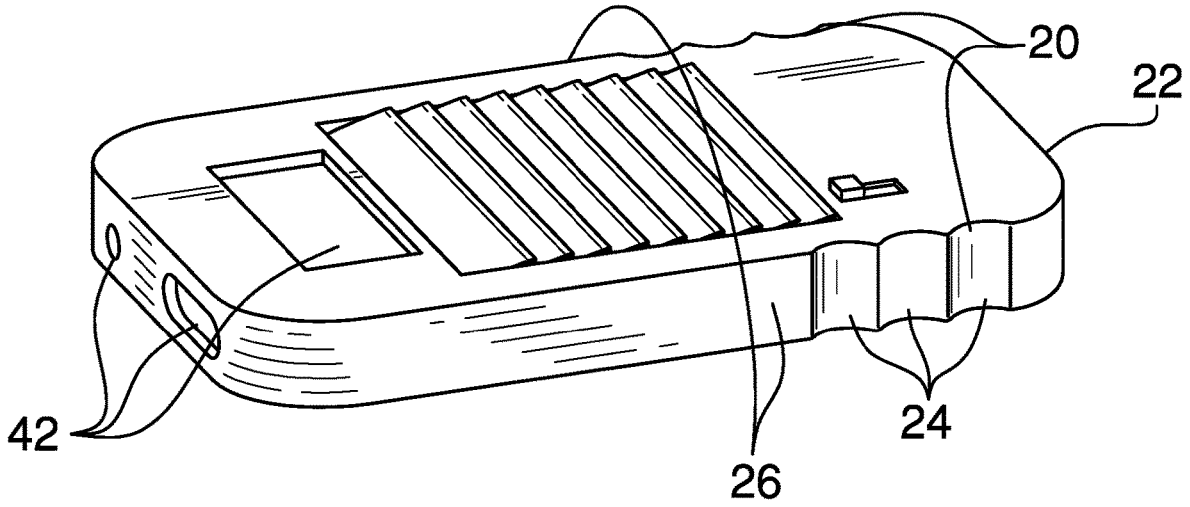
FIG. 7 is an isometric perspective view of an embodiment of the disclosure.

A grip 20 is coupled to the shell 12 proximate to a bottom 22 of the shell 12, as shown in FIG. 7. The grip 20 is configured to enhance a grasp of a user on the shell 12. The grip 20 comprises a plurality of indentations 24. Each indentation 24 extends into a respective opposing side 26 of the shell 12. The indentations 24 are arcuate. The plurality of indentations 24 comprises six indentations 24 that are positioned three-apiece in each opposing side 26.

A panel 28 is coupled to the shell 12 and defines a recess 30 and a chamber 32 in the interior space 14. The recess 30 is configured to insert an electronic device of a user to couple the electronic device to the shell 12.

Figure 3:
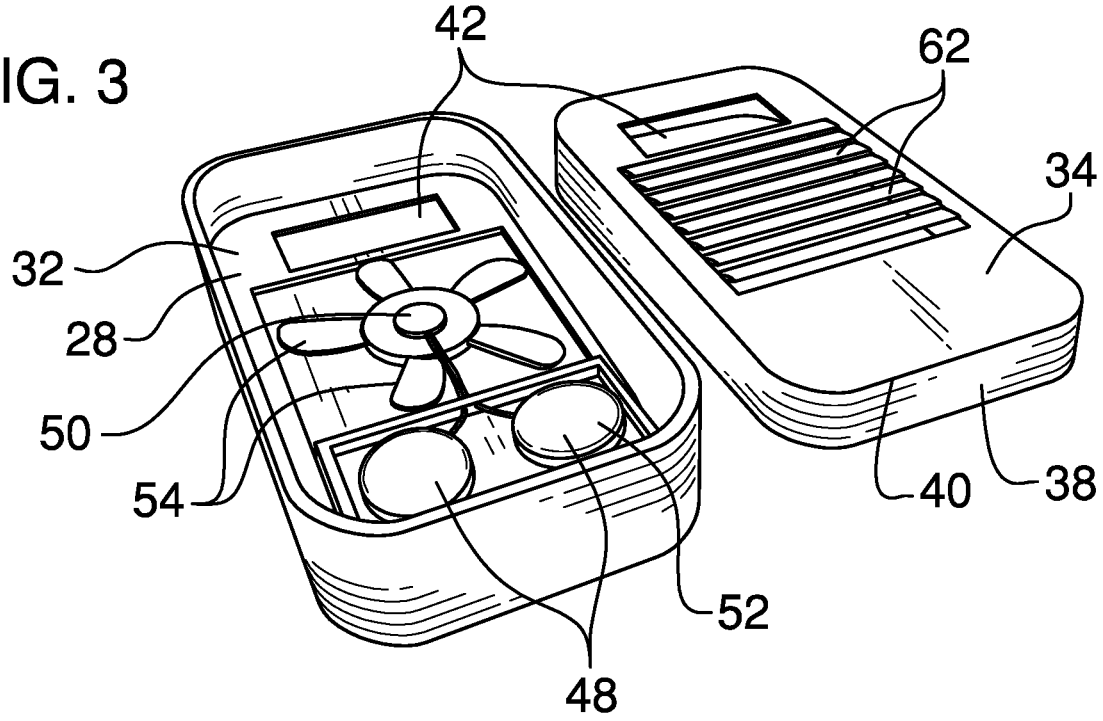
FIG. 3 is an isometric perspective view of an embodiment of the disclosure.
Figure 4:
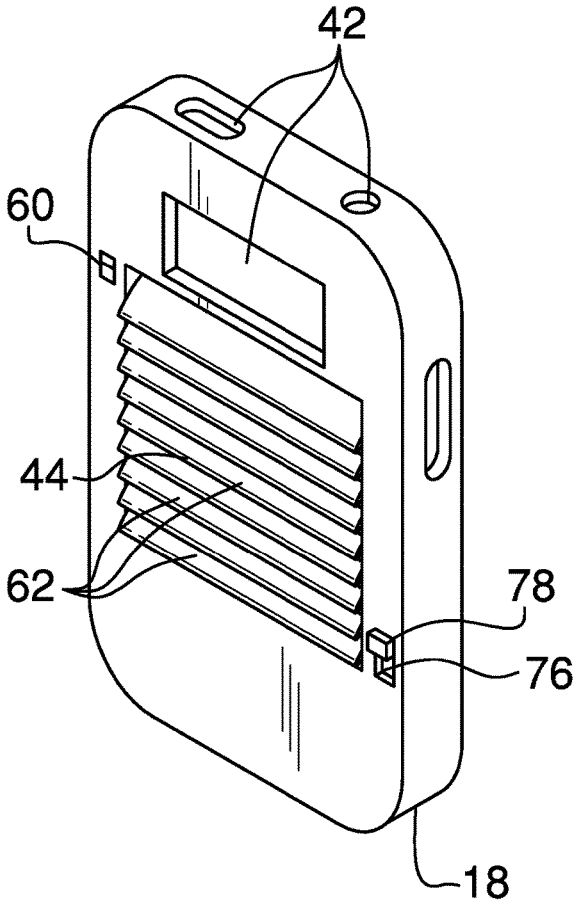
FIG. 4 is an isometric perspective view of an embodiment of the disclosure.
Figure 5:
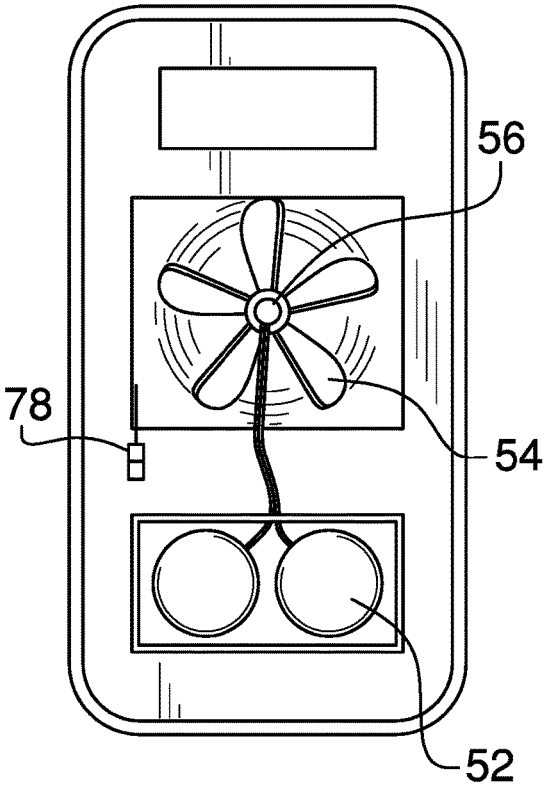
FIG. 5 is a front view of an embodiment of the disclosure.

As shown in FIGS. 3, 4, and 5, a front 34 of the shell 12 is reversibly couplable to a top 36, the bottom 22, and the opposing sides 26 of the shell 12. A wall 38 is coupled to, extends perpendicularly from, and annularly around a perimeter 40 of the front 34 of the shell 12. The wall 38 is positioned to insert into the chamber 32 to couple the front 34 to the shell 12.

A plurality of holes 42 is positioned in the shell 12 and the panel 28. Each hole 42 is configured to align with a respective functional element of the electronic device, such as a switch, a port, and a camera.

An orifice 44 is positioned in the front 34 of the shell 12. The orifice 44 is rectangularly shaped. A blower 46 is coupled to the shell 12 and is positioned in the chamber 32. The blower 46 is configured to force air through the orifice 44 onto the user to cool the user.

The blower 46 comprises a power module 48 and a motor 50. The motor 50 is operationally coupled to the power module 48. The power module 48 comprises a battery 52. The battery 52 is rechargeable. A plurality of blades 54 is coupled to and extends from a shaft 56 of the motor 50. The motor 50 is positioned to rotate the blades 54 concurrently with the shaft 56 to force the air through the orifice 44 onto the user to cool the user.

A controller 58 is operationally coupled to the power module 48 and the motor 50. The controller 58 is positioned to selectively couple the motor 50 to the power module 48 to power the motor 50. The controller 58 comprises a slide switch 60.

Each of a plurality of slats 62 is coupled to the shell 12 and extends between opposing edges 64 of the orifice 44 to position the slats 62 to shield the blower 46. The slats 62 are configured to direct the air that is forced through the orifice 44. In yet another embodiment, as shown in FIGS. 4, 6, and 7, the slats 62 are pivotally coupled to the shell 12.

An actuator 66 is coupled to the shell 12 and is positioned in the chamber 32. The actuator 66 is operationally coupled to the plurality of slats 62. The actuator 66 is configured to urge the plurality of slats 62 from a closed configuration to an open configuration.

Figure 6:
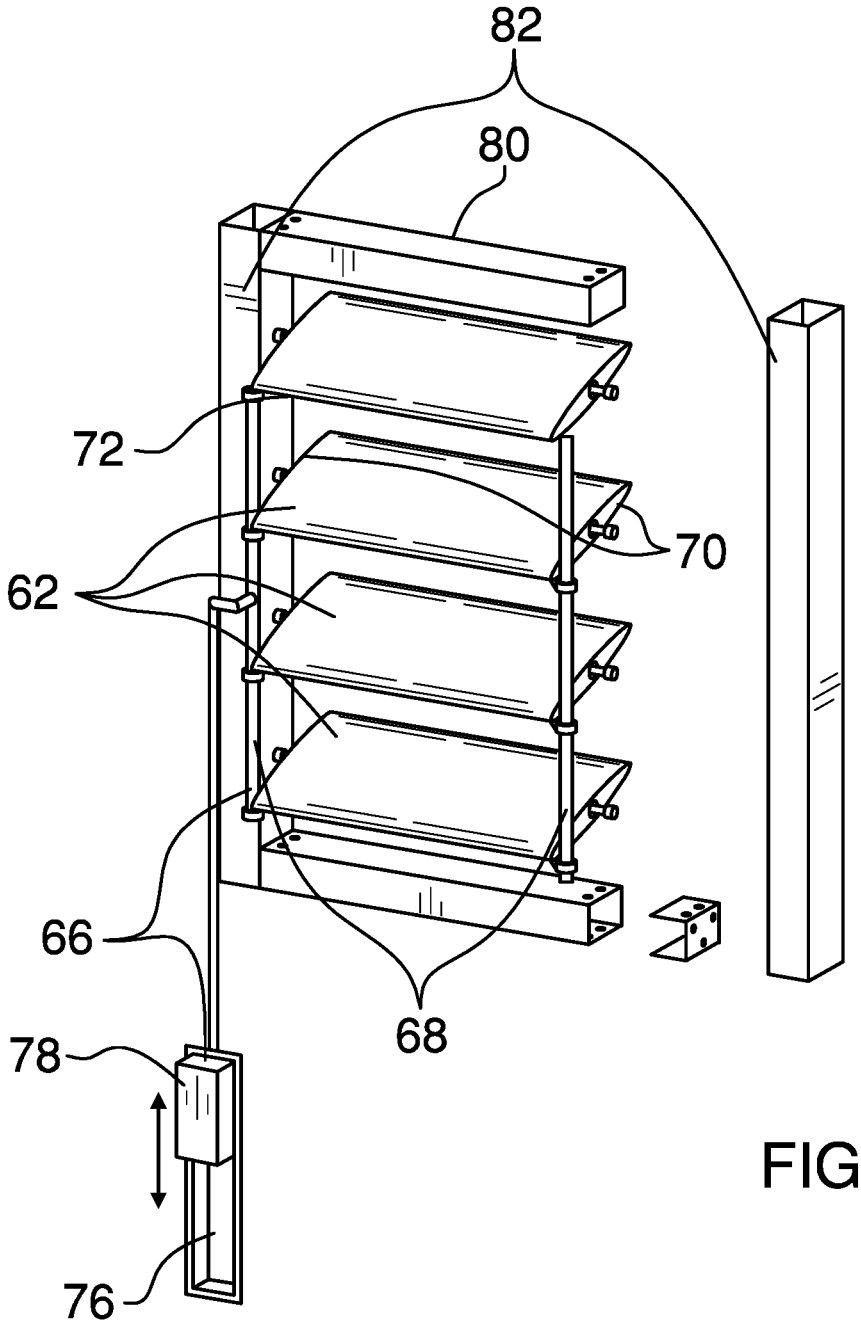
FIG. 6 is an isometric perspective view of an embodiment of the disclosure.

The actuator 66 comprises a pair of rods 68, as shown in FIG. 6. Each rod 68 is pivotally coupled to a respective opposing end 70 proximate to an external edge 72 of each of the slats 62. The rod 68 is positioned proximate to an associated opposing edge 64 of the orifice 44. A bar 74 is coupled to a respective rod 68. An aperture 76 is positioned through the front 34 of the shell 12. A button 78 is coupled to the bar 74 distal from the respective rod 68. The button 78 protrudes from the shell 12 through the aperture 76. The button 78 is configured to be selectively slid relative to the shell 12 to urge the bar 74 toward the top 36 of the shell 12. The respective rod 68 is urged concurrently with the bar 74 to urge the plurality of slats 62 from the closed configuration to the open configuration.

A frame 80 is coupled to the front 34 of the shell 12 and is positioned in the chamber 32. The frame 80 extends annularly around the orifice 44. Each slat 62 is pivotally coupled to the frame 80 and extends between opposing side members 82 of the frame 80, as shown in FIG. 6.

In use, the electronic device of the user is inserted into the recess 30 to couple the electronic device to the shell 12. The slide switch 60 is used to couple the motor 50 to the power module 48. The button 78 is slid relative to the shell 12 to selectively positioned the plurality of slats 62 in the open configuration to direct the air that is forced through the orifice 44 onto the user to cool the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal fanning assembly comprising:

a shell defining an interior space, said shell having a wall defining an open back;

a panel coupled to said shell defining a recess and a chamber in said interior space wherein said recess is configured for inserting an electronic device of a user for coupling the electronic device to said shell;

a plurality of holes positioned in said shell and said panel wherein each said hole is configured for aligning with a respective functional element of the electronic device;

an orifice positioned in a front of said shell;

a blower coupled to said shell and positioned in said chamber wherein said blower is configured for forcing air through said orifice onto the user for cooling the user; and a plurality of slats, each said slat being coupled to said shell and extending between opposing edges of said orifice positioning said slats for shielding said blower wherein said slats are configured for directing the air forced through said orifice.

2. The assembly of claim 1, further including said shell being substantially rectangularly shaped.

3. The assembly of claim 2, further including said shell having corner edges, said corner edges being arcuate.

4. The assembly of claim 1, further including a grip coupled to said shell proximate to a bottom of said shell wherein said grip is configured for enhancing a grasp of a user on said shell.

5. The assembly of claim 4, further including said grip comprising a plurality of indentations, each said indentation extending into a respective opposing side of said shell, said indentations being arcuate.

6. The assembly of claim 5, further including said plurality of indentations comprising six said indentations positioned three-apiece in each said opposing side.

7. The assembly of claim 1, further including said orifice being rectangularly shaped.

8. The assembly of claim 1, further including said blower comprising:

a power module;

a motor operationally coupled to said power module; and a plurality of blades coupled to and extending from a shaft of said motor wherein said motor is positioned for rotating said blades concurrent with said shaft for forcing the air through said orifice onto the user for cooling the user.

9. The assembly of claim 8, further including said power module comprising a battery.

10. The assembly of claim 9, further including said battery being rechargeable.

11. The assembly of claim 8, further including a controller operationally coupled to said power module and said motor wherein said controller is positioned for selectively coupling said motor to said power module for powering said motor.

12. The assembly of claim 11, further including said controller comprising a slide switch.

13. The assembly of claim 1, further comprising:

said slats being pivotally coupled to said shell; and an actuator coupled to said shell and positioned in said chamber, said actuator being operationally coupled to said plurality of slats wherein said actuator is configured for urging said plurality of slats from a closed configuration to an open configuration.

14. The assembly of claim 13, further including said actuator comprising:

a pair of rods, each said rod being pivotally coupled to a respective opposing end proximate to an external edge of each of said slats such that said rod is positioned proximate to an associated said opposing edge of said orifice;

a bar coupled to a respective said rod;

an aperture positioned through said front of said shell; and a button coupled to said bar distal from said respective said rod, said button protruding from said shell through said aperture wherein said button is configured for selectively sliding relative to said shell for urging said bar toward a top of said shell wherein said respective said rod is urged concurrently with said bar such that said plurality of slats is urged from the closed configuration to the open configuration.

15. The assembly of claim 13, further including a frame coupled to said front of said shell and positioned in said chamber, said frame extending annularly around said orifice, each said slat being pivotally coupled to said frame and extending between opposing side members of said frame.

16. A personal fanning assembly comprising:

a shell defining an interior space, said shell having a wall defining an open back, said shell having a front, said shell being substantially rectangularly shaped, said shell having corner edges, said corner edges being arcuate;

a grip coupled to said shell proximate to said bottom of said shell wherein said grip is configured for enhancing a grasp of a user on said shell, said grip comprising a plurality of indentations, each said indentation extending into a respective said opposing side of said shell, said indentations being arcuate, said plurality of indentations comprising six said indentations positioned three-apiece in each said opposing side;

a panel coupled to said shell defining a recess and a chamber in said interior space wherein said recess is configured for inserting an electronic device of a user for coupling the electronic device to said shell;

a plurality of holes positioned in said shell and said panel wherein each said hole is configured for aligning with a respective functional element of the electronic device;

an orifice positioned in said front of said shell, said orifice being rectangularly shaped;

a blower coupled to said shell and positioned in said chamber wherein said blower is configured for forcing air through said orifice onto the user for cooling the user, said blower comprising:

a power module, said power module comprising a battery, said battery being rechargeable, a motor operationally coupled to said power module a plurality of blades coupled to and extending from a shaft of said motor wherein said motor is positioned for rotating said blades concurrent with said shaft for forcing the air through said orifice onto the user for cooling the user, and a controller operationally coupled to said power module and said motor wherein said controller is positioned for selectively coupling said motor to said power module for powering said motor, said controller comprising a slide switch;

a plurality of slats, each said slat being coupled to said shell and extending between opposing edges of said orifice positioning said slats for shielding said blower wherein said slats are configured for directing the air forced through said orifice, said slats being pivotally coupled to said shell;

an actuator coupled to said shell and positioned in said chamber, said actuator being operationally coupled to said plurality of slats wherein said actuator is configured for urging said plurality of slats from a closed configuration to an open configuration, said actuator comprising:

a pair of rods, each said rod being pivotally coupled to a respective opposing end proximate to an external edge of each of said slats such that said rod is positioned proximate to an associated said opposing edge of said orifice, a bar coupled to a respective said rod, an aperture positioned through said front of said shell, and a button coupled to said bar distal from said respective said rod, said button protruding from said shell through said aperture wherein said button is configured for selectively sliding relative to said shell for urging said bar toward said top of said shell wherein said respective said rod is urged concurrently with said bar such that said plurality of slats is urged from the closed configuration to the open configuration; and a frame coupled to said front of said shell and positioned in said chamber, said frame extending annularly around said orifice, each said slat being pivotally coupled to said frame and extending between opposing side members of said frame.

* * * * *